United States Patent [19]

Fenster

[11] 4,015,306

[45] Apr. 5, 1977

[54] APPLICATOR PADS

[76] Inventor: Larry A. Fenster, 301 Birch Drive, Roslyn, N.Y. 11576

[22] Filed: Nov. 21, 1973

[21] Appl. No.: 417,926

Related U.S. Application Data

[62] Division of Ser. No. 264,631.

[52] U.S. Cl. ..... 15/209 R; 15/227; 15/244 B

[51] Int. Cl.[2] ..... A47L 13/16

[58] Field of Search ..... 15/208, 209 R, 209 A, 15/210 R, 104.93, 104.94, 227, 258, 244 C, 244 B; 156/180

[56] References Cited

UNITED STATES PATENTS

| | | | |
|---|---|---|---|
| 1,873,503 | 8/1932 | Stewart | 15/209 R |
| 2,198,164 | 4/1940 | Hall | 15/210 R |

*Primary Examiner*—Peter Feldman
*Attorney, Agent, or Firm*—Abner Sheffer

[57] ABSTRACT

An applicator pad for an automobile polish having a resilient foam core covered by layers of heat-sealable film and outer fabric. The edges of the fabric are adhered together by the heat-sealed edge of the film.

9 Claims, 8 Drawing Figures

APPLICATOR PADS

This is a divisional, of application Serial No. 264,631 filed June 20, 1972, now U.S. Pat. No. 3,802,024.

This invention relates to applicator pads and particularly to pads employed for application of polishes, such as waxes, to the outer painted surfaces of automobile bodies.

Wax compositions for the cleaning and polishing of automobiles are well known in the art. They are commonly sold in cans having friction-sealing lids and in association with pads for use in applying the composition. Thus in one well known commercial product the composition is an aqueous hydrocarbon emulsion and the applicator pad comprises a flat circular block of polyurethane foam enclosed between two circular pieces of tricot fabric which are stitched together around the circular periphery of the block of foam. The manufacturer's directions for use of the composition are that it should be applied with the pad moistened with water and wrung out damp dry. One section of the automobile (e.g. the hood or a fender) at a time should be covered with the composition, by means of the pad, using firm circular motions. As the pad gets dirty it should be rinsed in clean water and wrung out. The composition, which should be used sparingly and spread thinly, should be allowed to dry to a milky haze on the automobile surface and then wiped with a clean cloth. Typically the pad is placed in the can of polish or in an enclosure attached to that can. One common arrangement is the one illustrated in the accompanying FIG. 6 in which the pad 3 is situated atop the can 4 (and in contact with the can lid 6) within a transparent plastic enclosure 7 that is held on the can by being snapped over the outer rim of the can. The can generally contains sufficient composition for several polishings of the automobile and the pad is therefore used, allowed to dry out, and then, after some time, reused by the automobile owner when he thinks the car needs to be polished again; and this process is repeated several times with the same pad.

Typically the waxes or polishes are now sold in association with the pad, for use by the owner of the car, under such trademarks as "Rally" cream wax; Johnson's pre-softened paste wax; Turtle Wax, prewhipped formula (detergent proof): "Simonize Vista Soft and Easy". They are intended to clean and polish automobile surfaces including those carrying such paints as the conventional hard acrylic and super-enamel finishes.

In accordance with one aspect of this invention there is provided a novel applicator pad which may be used to replace the known applicator pads described above. This novel pad is not only more economical to manufacture but it gives unexpectedly superior results in use. It is found to have excellent polish-application properties, to be highly washable and rinsable, to have high dimensional and shape stability and good appearance, and to retain these properties throughout repeated use.

One embodiment of the invention is illustrated in the accompanying drawing in which FIG. 1 is a schematic side view of the assembled components of the product showing their relationship before the sealing operation;

Figure 1:
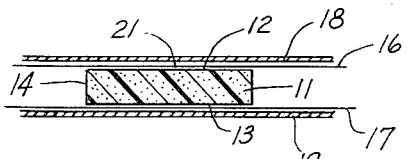
Figure 6:
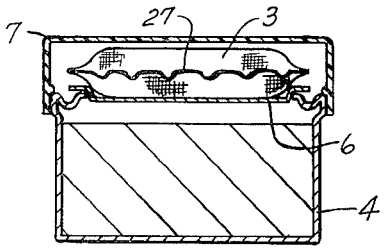
FIG. 6 is a cross-sectional view of a package containing the pad and the composition.
Figure 2:
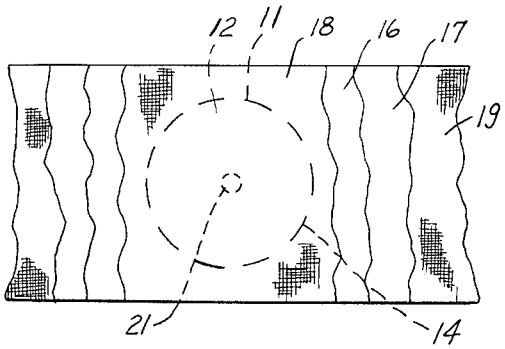
FIG. 2 is a schematic top view of the assembled components of FIG. 1, with the edges of the sheets of film and fabric broken away.

In the assemblage shown in FIG. 1, reference numeral 11 indicates a piece of elastomeric foam such as polyurethane foam. In one particularly suitable form of the invention the piece of foam is a flat circular block, (as indicated in FIG. 2) having flat top and bottom faces 12, 13 and a circular periphery 14.

The foam is placed between two inner sheets 16, 17 of heat sealable film, such as the flexible heat-sealable vinyl resin film conventionally employed for dielectric sealing, and two outer sheets 18, 19 of fabric. At least one of the sheets of film has at least one hole 21 which permits air to pass to and from the foam block 11.

Figure 3:
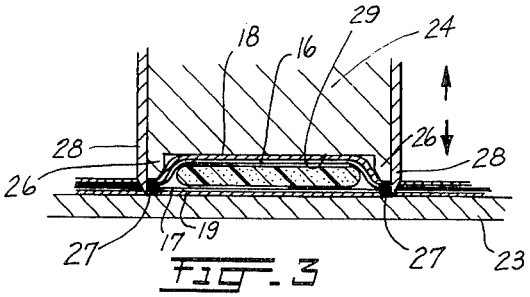
FIG. 3 is a schematic view, in cross section, of the heat sealing operation.

The film and fabric layers are then heat sealed together and their edges are cut at the heat seal zone. As illustrated in FIG. 3 the assemblage rests on the platen 23 of a heat-sealing press, below the heat-sealing and cutting die 24 of the press. The die 24 is mounted for reciprocating movement up and down and it has a downwardly projecting lip or rule 26 which, when the die is lowered, presses down on the upper layer of fabric around the periphery of the block of foam thereby pressing the assemblage of fabric and film layers along a continuous narrow band, between the rule 26 and the platen 23. At this time heat is generated dielectrically (in conventional manner by localized high frequency radiation, as is well known in the operation of dielectric heat sealing presses) in the film; this causes the film layers to become soft enough so that they are bonded to each other and to the adjacent fabric layers along the narrow compressed band 27. Adjacent the pressing and heat-sealing rule 26 there is a sharp cutting rule 28. The parts are arranged so that the same downward motion of the die causes the fabric and film to be cut by rule 28, along the outer periphery of the heat sealed band.

Figure 4:
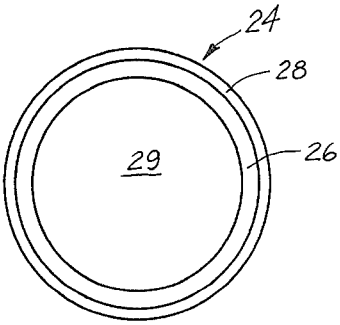
FIG. 4 is a plan view, looking upward, of a die.

The die 24 also has a face 29 which is situated within the boundary defined by the rule 26 and which is spaced vertically from the lower edge of that rule by a distance which is less than the thickness of the foam block. Accordlingly, when the die is lowered the face 29 presses against the assemblage and compresses and flattens the foam block. This causes the foam block to expand somewhat in a lateral direction. Air is forced from the foam during this compression, and escapes through the hole 21 of the film and through the interstices of the fabric. The rule 26 is preferably so positioned that it permits such lateral expansion; that is, it surrounds and conforms closely the compressed laterally expanded foam block, but does not itself exert any downward pressure or heat-sealing effect thereon. In the illustrated embodiment the rule 26 is circular in plan view (see FIG. 4) to conform to the circular block of foam.

Preferably a conventional suitable buffering paper is placed on the platen in a position under the rules 26, 28. This serves the known function of aiding in the generation of dielectric heat (owing to the moisture in the paper) and in reducing loss of heat to the platen.

Figure 5:
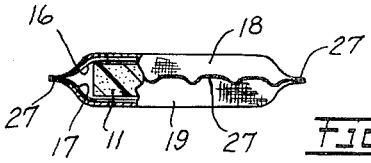
FIG. 5 is a view of the finished product, with parts broken away.

After the heat-sealing and cutting operation the die is raised, permitting the resulting complete pad to be removed. The removal of the pressure exerted on the foam block, by the face 29, permits the foam block to expand. It thereby presses gently against the broad faces of the enclosing layers of film and fabric, making those faces smooth and taut. This also causes a decrease in the diameter of the heat sealed assembly and thereby causes the heat-sealed band 27 to assume an attractive wavy or scalloped configuration as indicated in FIG. 5 (It will be understood that the length of the heat-sealed band is fixed by the heat-sealing operation which bonds the various layers together along that band and that when the diameter decreases this fixed length is accommodated by a folding of the band into the wavy configuration.)

The outer periphery of band 27 has a clean non-ravelling edge. Even when the fabric of the outer layers of the pad is one which ordinarily tends to unravel at a cut edge thereof, that tendency is substantially nullified by the heat-seal bonding.

The size and shape of the block of foam should be such that the finished pad is small enough to be held conveniently in the hand and large enough to take up a suitable amount of the polishing composition for efficient application. Generally it will be less than 7 inches and more than 2 inches in width; thus the diameter is typically on the order of 4 or 5 inches. Similar considerations apply to the thickness of the pad which is generally more than ¼ inch and less than 4 inches; thus a typical thickness is on the order of 1 inch.

Polyurethane foam, well known in the art, is an excellent material for this purpose. Generally, for reasons of feel and economy, it is found preferable to use an open-celled polyurethane foam having a specific gravity within the range of, say, about 0.01 to 0.05 (e.g. a density of 1 to 2 lbs. per cubic foot). A typical foam of this type may be readily compressed, by simple pressure between thumb and finger, to about 5 or 10% of its uncompressed thickness and will then return to its original thickness on release of the pressure. It will be understood by those skilled in the art that other resilient fillings may be used, such as blocks of other foamed polymers, e.g. foamed polyvinyl resins (such as foamed vinyl chloride-vinyl acetate copolymers or foamed polyethylene) or other materials of sufficient strength to withstand the compression and release of pressure that accompanies normal use (including wringing) of the applicator pad. It is also within the broader scope of the invention to use a collection of smaller pieces of resilient material instead of a unitary block thereof.

The fabric layers may also be of any suitable material. Thus, stretchy materials such as tricot knit cotton fabric (e.g. of the type conventionally employed for men's undershirts) or other knit material may be employed, as may be woven materials such as cotton terry cloth. It is also within the broad scope of the invention to use nonwoven fabrics. The fabric may be of natural or synthetic fibers (e.g. polyethylene terephthalate, nylon-6 or nylon-6,6) or of blends thereof. It is also within the broader scope of the invention to use, instead of two distinct pieces of fabric, a single piece folded over the foam core or a tubular fabric (e.g. a knit tube of known type) which surrounds the foam core. The bonding can then be done at the remaining free edges of the fabric, or all around the core as well, if desired.

Suitable dielectrically heat sealable grades of plastic film are well known in the art. The thickness of the film may be varied. For instance, when used with a tricot undershirt type of fabric a film 4 to 5 mils (0.004–0.005 inch) in thickness gives excellent results, but when thicker fabrics are employed, such as terrycloth, improved bonding may be obtained by using correspondingly thicker films (e.g of 8 to 10 mils thickness). Typically the film has a relatively low fusion temperature. It may, as is well known, be made of such materials as polyvinyl chloride, high- or low-density polyethylene, polypropylene, etc. The technique of "electronic" or dielectric sealing is described, for instance, in the Modern Packaging Encyclopedia (pub. by McGraw-Hill, Inc.) July 1971 (Vol. 44, No. 7A) and suitable heat-sealable films and sheets are described in that Encyclopedia at pages 144–146, for instance; it will be seen there that, depending on the material, the temperature at which the heat sealing takes place is usually in the range of about 200°–450°F.

While a flat circular pad has been illustrated, it will be understood that other shapes (e.g. square, rectangular or even spherical or ellipsoidal) will readily suggest themselves to those skilled in the art.

The hole in the film may be rather small. Thus, excellent results have been obtained when it was a single circular hole about 3/16 inch diameter. In another suitable construction there are four spaced one eighth inch diameter holes in each layer of film. In such constructions the total area of the holes is a very small fraction, well below 10% and generally not over about 2% (e.g. about 1% or ½%), of the total area of film. It will be appreciated that the interchange, if any, of water and polishing or cleaning material between the foam body and the outer fabric layer will take place at quite a different rate in the illustrated product (which uses a film which is substantially impermeable to these ingredients) as compared to prior art fabric-on-foam pads described above. Nevertheless, the illustrated pads have shown outstanding properties in application, rinsing and reuse. In fact they are found to be very long lasting. Unlike conventional pads used for the same purpose, their polyurethane foam cores take up relatively little of the wax in use. On repeated use and aging there is little or no substantial deposit of hardened wax in the pad and little deterioration of the foam core.

It will be understood that it is within the broader scope of the invention to use films which have a great many small holes, or larger holes, or to employ only one sheet of film so that the fabric on one side of the pad is directly in contact with the foam core.

The band 27 along which the film and fabric are bonded together is generally narrow, for instance well below ½ inch, preferably less than 0.3 inch, but usually well above 0.02 inch. For example, a very effective bond has been obtained (using tricot knit fabric) along a band width of about 0.05–0.01 inch (e.g.1/16 inch). The heat sealing under pressure causes the two films to fuse together along this band; it also often effects a marked flow of the material of the films into the interstices of the fabrics and their fibers, so that when the heat-sealed band is cooled to set the fused material, the fabrics are often physically locked together by the plastic which has taken on a physical configuration complementary to that of the fabrics on its opposite sides. The fibers of the fabric may be of a material, such as cotton, which retains its fibrous structure and does not itself become sticky at the temperatures used for fusion of the film. It is also within the broader scope of the invention to use fabrics made in whole or in part of fusible fibers such as cellulose acetate or nylon-6 or nylon-66.

For use in an applicator pad for aqueous compositions, the various materials of which the pad is made are preferably resistant to attack by water and by the aqueous composition.

When the pad is to be used for applying automobile wax the fabric layers should be relatively soft, non-abrasive to the surface being polished, resistant to constituents of the wax (e.g. hydrocarbon or other solvents) and preferably sufficiently resistant to wear so that the pad can be used for a plurality of polishings of the automobile (preferably a number of polishings corresponding at least to the amount of wax in the accompanying container). Particularly good results have been obtained with woven cotton terry cloth fabric weighing about 7, 8 or 9 ounces per square yard and tricot knit cotton undershirting fabric weighing about 4 ounces per square yard.

Figure 7:
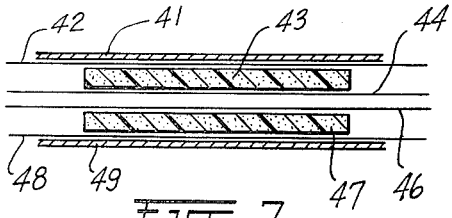
FIGS. 7 and 8 are schematic views showing the production of other articles, such as gloves, mitts, etc.
Figure 8:
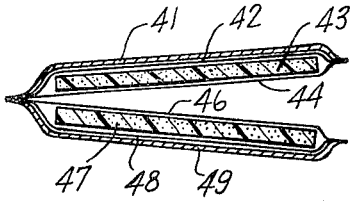

As indicated earlier, the disclosed method may also be employed for the production of other articles such as gloves, mittens, car-washing mitts, slippers, etc. For example in the manufacture of a glove one may employ an assemblage of a layer 41 of fabric (FIG. 7), a sheet 42 of heat-sealable film, a sheet 43 of relatively thin polyurethane foam (e.g. about ⅛ inch thick), second and third sheets 44, 46 of heat-sealable film, a second layer 47 of the thin foam, a fourth sheet 48 of film, and a second layer 49 of fabric. The rules of the die have the configuration of the outline of the glove and they thus heat-seal and out the various elements to that outline. Both of the sheets of polyurethane foam are pre-cut to conform to the shape of the outline of the glove but slightly smaller in size so that there is, say a ⅛ inch margin (for the heat-sealed band) between the cut edges of the assemblage and the edges of the foam. Suitable aligning means may be employed to obtain the desired registration of the parts; for instance one may use a series of locating pins penetrating through both foam layers and adapted to be fitted into aligning holes of the platen. At the portion of the glove which is to be open, a suitable barrier material (such as conventional non-adhering release paper) may be disposed between the two innermost sheets of film 44, 46 underneath the heat-sealing die rule so as to prevent those two sheets from sticking together. In the finished article shown schematically in FIG. 8, layers 41, 42 and 43 are heat sealed together at one end (at the right) and similarly the layers 46, 48 and 49 are heat sealed together at that end, but layers 44, 46 are not there bonded together. Thus, there is a space for a portion of the body, such as the hand, to be inserted (from the right in FIG. 8) between the two sheets of film 44, 46,. At the opposite end all the layers of film and fabric are preferably dielectrically heat sealed together as shown. If desired, one more of the film layers may have holes, as in the case of the pad. Also, the film layers may be of film material which has been microperforated in known manner throughout all, or most of its area to provide "breathability" and greater comfort. It will be understood that it is also within the broader scope of the invention to have an inner fibrous layer (e.g. of knitted, woven or non-woven fabric) next to the film layer 44 and heat-sealed thereto all around (and, if desired, a similar fibrous layer next to film layer 46) so that the hand or other inserted body portion will be in contact with fibrous material rather than film.

As mentioned previously, the automobile wax composition may contain a hydrocarbon solvent. Examples of such solvents are given in U.S. Pat. No. 2,949,374, whose disclosure is incorporated herein by reference. In that patent there is present not only a wax and a solvent, but also a finely divided abrasive, a silicone and a thickener.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

I claim:

1. A pad for applying automobile polish to the painted surfaces of an automobile, said pad comprising a resilient absorbant foam core and a fibrous fabric covering thereover, for applying said polish to the painted surface of an automobile by bringing said fabric covering, on said pad, into contact with said body of polish to pick up the polish thereon and then bringing said fabric covering, on said pad, into contact with said painted surface to apply the polish thinly to said surface, said pad being adapted to be compressed to express air therefrom and then permitted to expand during use and being adapted to be reused, said fabric covering comprising spaced layers of air-permeable fabric, covering opposite faces of said core, extending beyond the periphery of said core, and having meeting free edges adjacent said core, the improvement in which said pad comprises a film of heat-sealable organic plastic disposed on each of said faces of said core between said core and said covering and, around the entire periphery of said core, a fused band where said free fabric edges are joined to each other and to said film by fused film material, said film having a hole to permit air to flow from and to said core when said core is, respectively compressed and permitted to expand.

2. An applicator pad as in claim 1 in which said resilient core has substantially flat faces on opposite sides thereof and in which said fabric covering comprises a pair of pieces of fabric, one covering each of said faces, each of said pieces being larger than said faces whereby said faces extend beyond the periphery of said core, there being a film of said plastic on each of said faces and, around the periphery of said core, a fused band where said free fabric edges are joined to each other and to said films by fused film material.

3. A pad as in claim 1 in which said fabric covering is a soft fabric, non-abrasive to the surface being polished and sufficiently resistant to wear so that the pad can be used for a plurality of polishings of the automobile.

4. A pad as in claim 3 in which said fabric covering is a knitted fabric.

5. A pad as in claim 3 in which said fabric covering is a woven fabric.

6. A pad as in claim 3 in which said polish is adapted to be applied by a process in which said pad is moistened with water and wrung out damp dry before taking up said polish and in which as said pad gets dirty during use it is rinsed with water and wrung out, said fabric and said resilient core being sufficiently resistant to wear during said process that said pad can be used for a plurality of polishings of said automobile.

7. A pad as in claim 1 in which said polish is an automobile polishing wax composition adapted to be applied with a moistened fabric pad, said pad having a compressible elastomeric polyurethane foam core and a water-impermeable film resistant to the constituents of said composition surrounding said core and covered by said fibrous fabric.

8. A pad as in claim 2 in which the film on at least one of said faces has a plurality of holes.

9. A pad as in claim 6 in which said core is of elastomeric polyurethane and said film has a plurality of holes permitting said flow of air.

* * * * *